United States Patent [19]

Schlegel et al.

[11] Patent Number: 4,508,530

[45] Date of Patent: Apr. 2, 1985

[54] ENERGY RECUPERATION CENTRIFUGE

[75] Inventors: Raymond F. Schlegel, Colombes; René P. Bourassin, Neauphle-le-Chateau; Michel A. Lapautre, Ville D'Avray, all of France

[73] Assignee: Bertin & Cie, Plaisir, France

[21] Appl. No.: 523,949

[22] Filed: Aug. 17, 1983

[30] Foreign Application Priority Data

Aug. 27, 1982 [FR] France ..... 82 14702

[51] Int. Cl.[3] ..... B04B 1/00

[52] U.S. Cl. ..... 494/49; 494/52; 494/84

[58] Field of Search ..... 494/49, 50, 52, 53, 494/51, 54, 55, 56, 66, 85, 70, 84

[56] References Cited

U.S. PATENT DOCUMENTS

| | | | |
|---|---|---|---|
| 2,670,131 | 2/1954 | Ried | 494/51 |
| 2,747,793 | 5/1956 | Caddell . | |
| 3,282,497 | 1/1966 | Schmiedel | 494/51 |
| 3,430,853 | 3/1969 | Kirk . | |
| 3,934,792 | 1/1976 | High | 494/54 |
| 4,009,823 | 3/1977 | Stepanovich | 494/53 |

FOREIGN PATENT DOCUMENTS

| | | |
|---|---|---|
| 1532676 | 2/1970 | Fed. Rep. of Germany . |
| 1455032 | 9/1966 | France . |
| 2379320 | 1/1978 | France . |
| 574667 | 1/1946 | United Kingdom . |

*Primary Examiner*—Robert W. Jenkins
*Attorney, Agent, or Firm*—A. W. Breiner

[57] ABSTRACT

Centrifuge comprising two drums (1,2) having coaxial horizontal axes. The inner drum carries a set of dishes (33) and, on the periphery, a scraper screw (36). A sludge chamber (23) is provided at one end of the outer drum (2) and, by way of passages (28) adapted to be closed by a discharge device, is in communication with the outside.

The centrifuge is provided with a double energy recuperation device comprising a centripetal wheel (38) and a ring (40) of ejectors fastened to the inner drum, together with blading (42) fixed opposite the ejectors.

The ejectors (42) are so directed that the absolute speed of the fluid leaving the centrifuge is low.

The discharge device comprises an overflow (26) continuously fed in order to hold, by pressure, a movable plate (19) in the closed position in front of the passages (28).

14 Claims, 6 Drawing Figures

FIG. 3
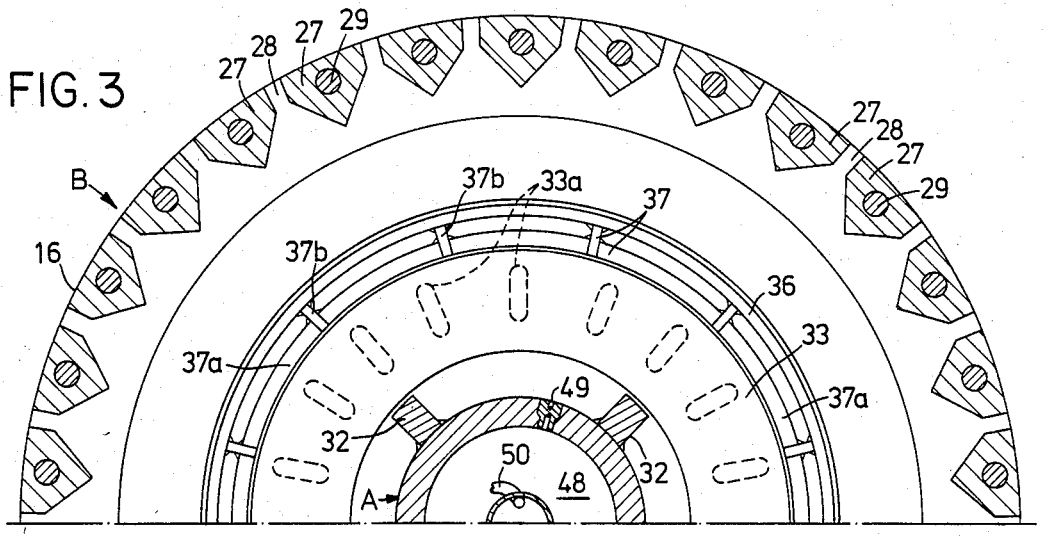
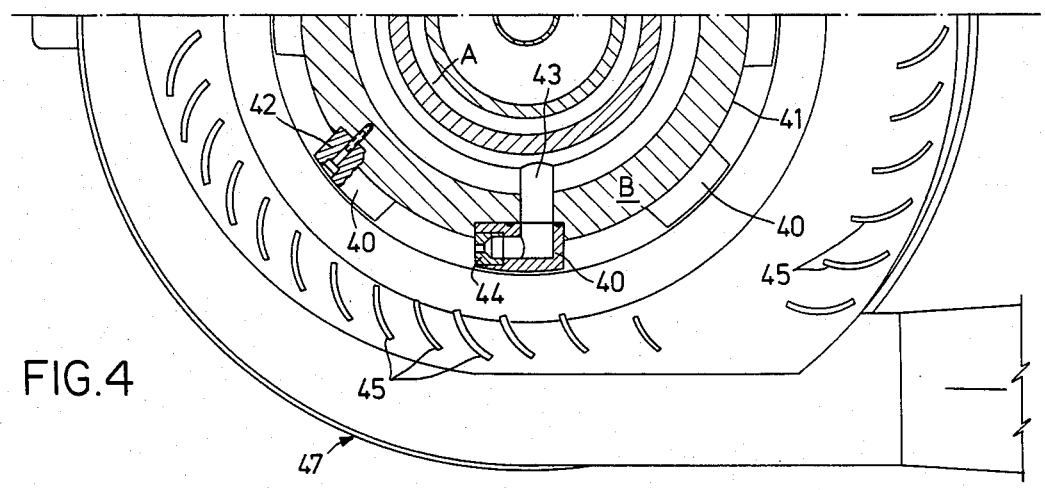
FIG. 4
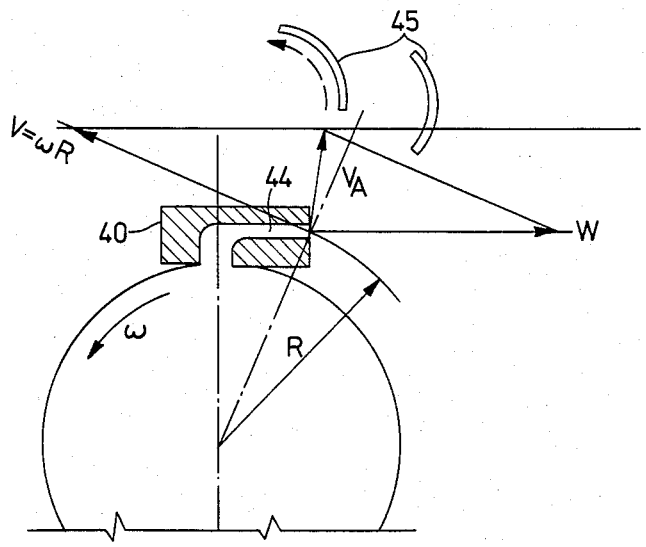
FIG. 5

ENERGY RECUPERATION CENTRIFUGE

The invention relates to an energy recuperation centrifuge, which is more particularly intended for the separation of immiscible liquids of different densities, in which solid particles are dispersed, the centrifuge comprising two coaxial rotating drums, a device for the discharge of the solid materials and an energy recuperation device.

Industrial centrifuges intended for the separation of emulsions of liquids or suspensions of solid materials in liquids are machines intended for the continuous treatment of large throughputs. Apart from their high price, the heavy consumption of energy required for their operation has greatly hampered their development, and their use has been restricted to the chemical and petroleum industries, in which they are used for the separation of products having a certain commercial value.

In the case of products of negligible value, such as those contained in industrial effluents, separation by decantation for longer or shorter periods of time in tanks or basins is generally sufficient. Since pollution problems are becoming increasingly acute, the pollutant content of waste material, for example sludges, emulsions or suspensions of oil or grease, is progressively lowered and compliance with such standards will require the use of high-output centrifuges whose operating costs are not prohibitive.

French Pat. No. 2,361,942 thus describes a coaxial drum, horizontal axis centrifuge used in the paper industry for separating solids from liquids. The liquid charged with solids arrives in the space separating two cylindroconical drums rotating at high speed, a fixed differential speed being established between the outer drum and the inner drum. The inner drum is provided with a blade constituting an Archimedean screw, which continuously removes deposits of solid materials and discharges them to the conical end of the drums. The liquid is discharged to the cylindrical end.

The separation is not very thorough and the finest particles remain in suspension.

In order to increase the effectiveness of a centrifuge, French Pat. No. 2,326,981 proposes to equip a vertical axis centrifuge bowl with a set of conical dishes fastened on the central shaft. The dishes are separated from one another by a small space into which the liquid charged with solids penetrates and in which the liquid is separated from the solid particles. The liquid is discharged to the interior of the bowl, while the particles collect in a biconical chamber formed by the wall of the bowl, before being expelled radially to the outside by the operation of a discharge device.

The high-output industrial centrifuge with improved energy efficiency, which forms the subject of the invention, is particularly adapted for purifying a liquid containing denser solid particles in suspension and/or droplets of a less dense fluid in emulsion.

It comprises a rotor essentially consisting of a stack of centrifuging dishes rotating at high speed between two coaxial cylindrical drums, means for continuously introducing and discharging the liquid, which completely fills the space inside the rotor, and means for the selective extraction of the separated impurities.

A first characteristic of the machine is that in the space between the outer cylindrical drum and the inner drum, which drums are independently driven in coaxial rotation and are respectively provided with means for the discharge of the separated phases, is disposed the stack of dishes which rotates with the inner drum and which is fed with liquid to be purified through an axial inlet and a centrifugal wheel.

Another characteristic of the invention is a device for the recuperation of the energy of the liquid discharged.

This device comprises, at the purified liquid outlet, an outlet wheel provided with blades fastened to the inner drum and forming a centripetal turbine, this turbine being followed by tangential ejectors fastened to the outer drum and constituting a reaction turnstile arranged in such a manner that the absolute exit speed of the purified liquid will be substantially zero.

In this way, the turbine and the turnstile restore in the form of driving torque the major part of the kinetic moment imparted to the liquid, thus making it possible to limit the power required for operating the machine, under continuous operating conditions, to compensation for frictional losses.

The explanations given below and the accompanying drawings, given by way of example, will make it possible to understand how the invention can be put into practice.

FIG. 3 is a partial view in radial section on the line III—III in FIG. 2.

FIG. 4 is a partial view in radial section on the line IV—IV in FIG. 2.

FIG. 5 is a diagram of the composition of the velocities of the fluid passing out of an ejector in the energy recuperation device.

Figure 1:
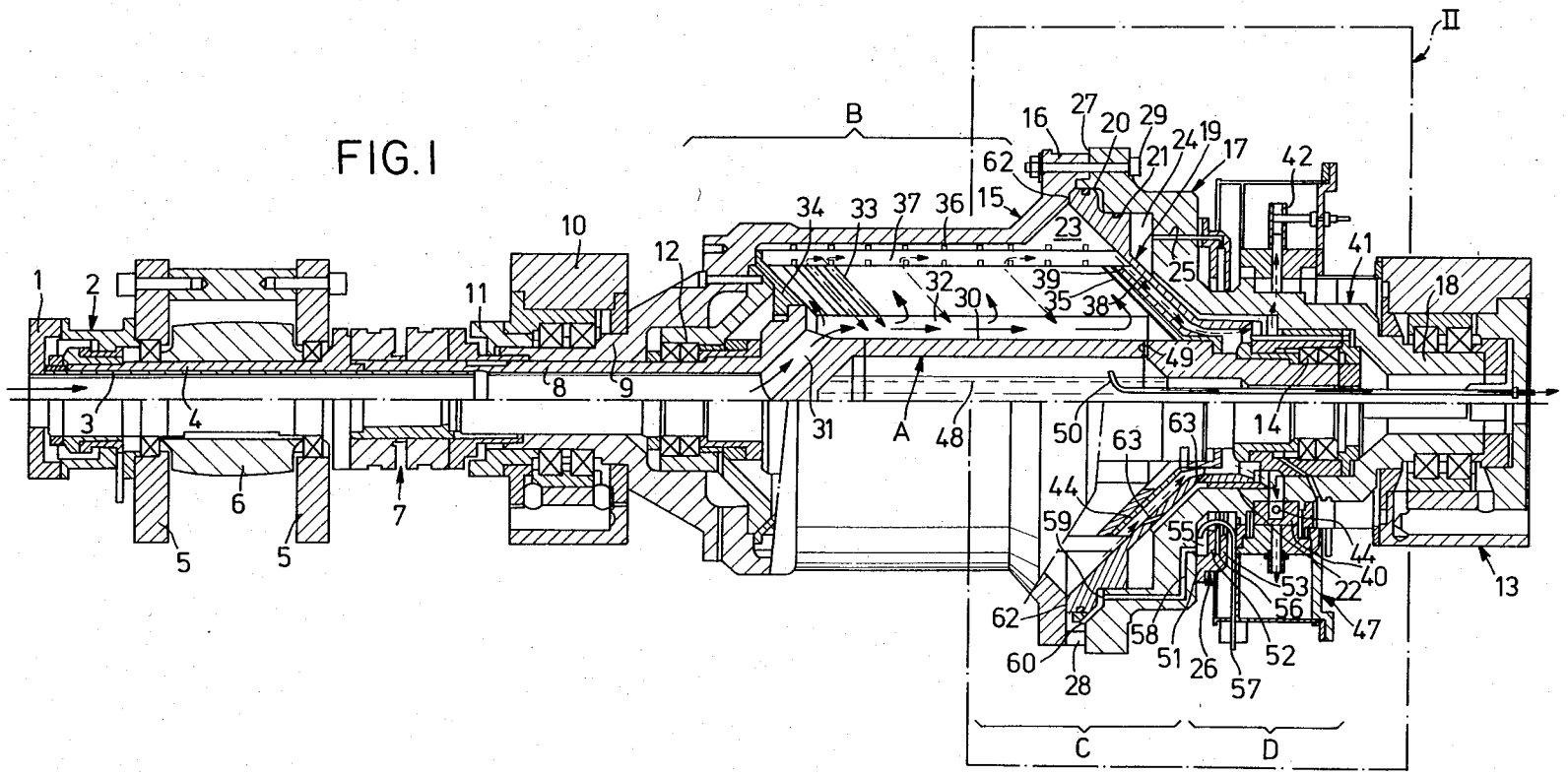
FIG. 1 is a longitudinal section of a centrifuge according to the invention.

The horizontal axis centrifuge shown in FIGS. 1 to 4 comprises schematically an inner drum A, an outer drum B, a solid material discharge device C and an energy recuperation device D.

The liquid to be purified enters on the upstream side through the connection 1, which is equipped with a rotating seal unit 2 and is extended by a fixed inner sleeve 3, penetrating into the hollow shaft 4 whose opposite end is connected to the inner drum A.

The shaft 4 is supported by a double ball bearing 5, between whose flanges is provided a pulley 6 keyed on the shaft and driven by a belt (not shown). The hollow shaft 4 is connected by a fluidtight resilient coupling 7 to the tubular end 8 of the inner drum A. The corresponding end 9 of the outer drum B is supported by an outer ball bearing 10 and is provided with a pulley 11 enabling it to be driven at a speed different from that of the inner drum. A fluidtight ball bearing 12 is disposed between the outer and inner drums. The other end of the outer drum B is supported by a ball bearing 13. The corresponding end of the inner drum A is supported by a fluidtight ball bearing 14 disposed between the drums.

The centrifuge bowl, forming the greater part of the outer drum B, is composed of a cylindrical hollow body extended on the upstream side by a cylindroconical end member fastened to its end 9 supported by the bearing 10, and on the downstream side by a widened collar 15 carrying a circular flange 16. On this flange is fastened a head 17, whose cylindrical end 18 is supported by the bearing 13. The head 17 carries in its interior a movable conical plate 19, which slides sealingly, on the one hand on two stepped bearing surfaces 20, 21 provided in the portion of the head which is near the flange 16, and on the other hand in a tubular liner 22 inserted in the head 17 (see the view on a larger scale in FIG. 2).

The movable plate 19 bounds on the one hand, together with the widened collar 15, a sludge chamber 23, and on the other hand, together with the portion of the head 17 which is inside its inner bearing surface 21, a pressure chamber 24 fed by means of the duct 25 from an overflow 26, which will be described later on.

As shown in FIG. 3, the flange 16 of the bowl, bearing against the periphery of the head 17, is not continuous but is provided with bosses 27 distributed regularly around the entire flange and separated by passages 28, fastening bolts 29 passing through these bosses.

Figure 2:
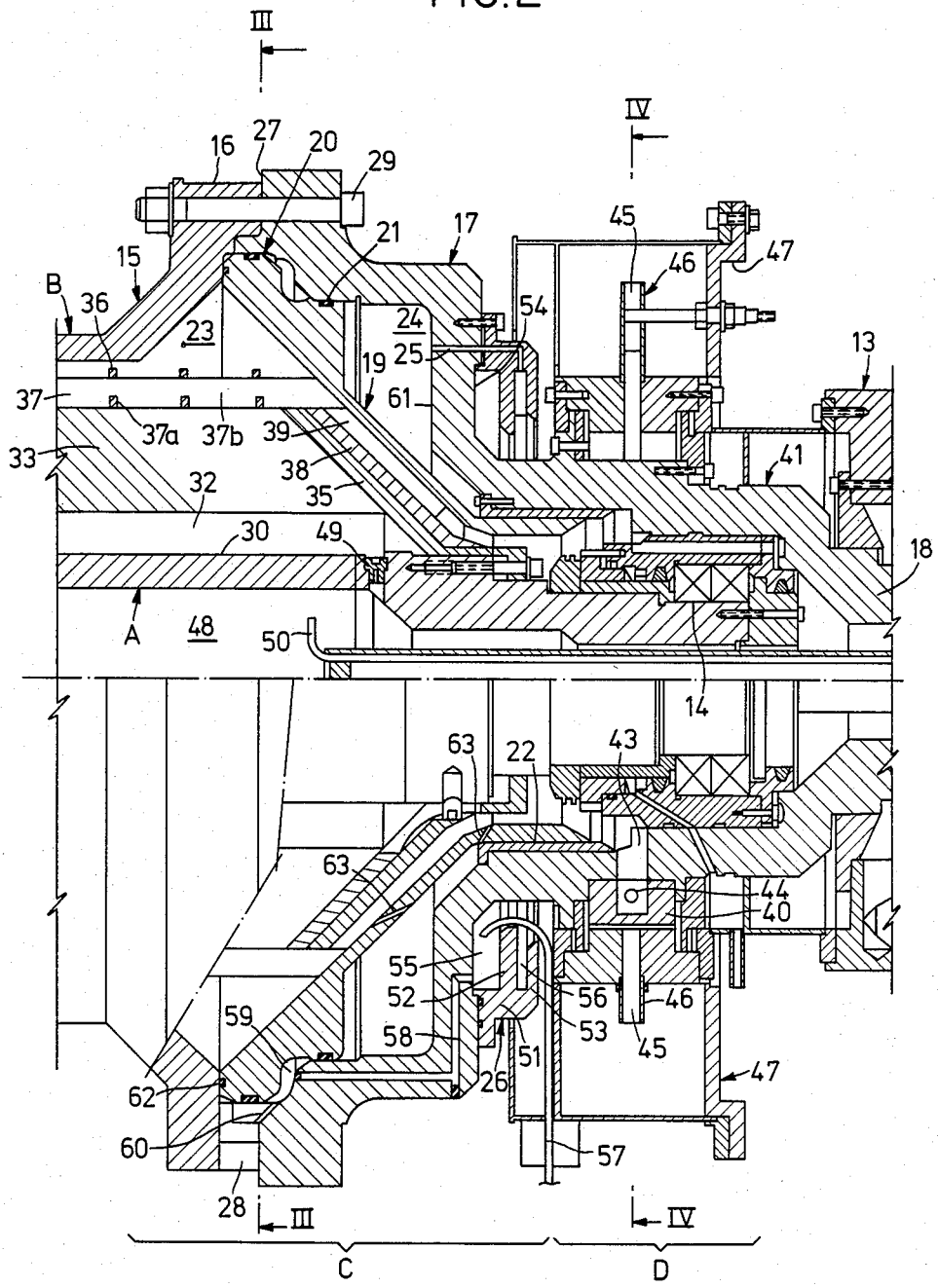
FIG. 2 is a view on a larger scale of part of FIG. 1.

When the movable plate 19 is in the position shown in FIGS. 1 and 2, its periphery bearing axially against an inner radial bearing surface of the flange 16 prevents all communication between the interior of the bowl and the exterior. When the plate 19 is moved towards the right in the drawing, its periphery uncovers the passages 28, which permit the emptying of the sludge chamber 23 through simple centrifugal action.

The inner drum A is connected by its tubular end 8 to the end of the hollow shaft 4, through which is admitted the effluent or mixture to be treated, which enters the annular space formed between the outer surface 30 of the inner drum A and the inner wall of the outer drum B by way of inclined channels 31 forming an inlet wheel. As shown in FIG. 3, the outer surface 30 carries longitudinal ribs 32 forming keys, by which a stack of conical dishes 33 (shown in part) is driven rotationally. These dishes of frustoconical shape are spaced apart by stamped or attached radial spacers 33*a*, their spacing being dependent on the size of the particles which are to be separated and on the required output. The small bases of the dishes are directed downstream in the axial direction of circulation of the liquid being treated. The stack of dishes is supported on the upstream side by a plate 34 and on the downstream side by a dish clamp 35.

On the periphery of the dishes a scraper screw 36 is fixed with the aid of the plate 34. This screw is for example composed of a rectangular sectional bar wound helically over a cage 37 formed by the assembly of peripheral rings 37*a* and longitudinal bars 37*b*. The outside diameter of the screw 36 is slightly smaller than the inside diameter of the bowl B, so that it can scrape off the solid particles accumulating on the wall and deliver them axially to the sludge chamber 23, their movement resulting from the difference in the speeds of rotation of the inner drum A and outer drum B.

At the downstream end of the set of dishes 33 a radial centripetal wheel 38 is provided, which is in the form of a frustoconical casing fastened to the dish clamp 35 and carrying, fixed on its surface, blades 39 projecting into the space formed between the dish clamp 35 and the movable plate 19 of the outer drum B.

The wheel 38 forms the first stage of the energy recuperation device D, the second stage of which is composed of a series of ejectors 40 forming a turnstile and fixed on the cylindrical surface 41 of the outer drum B, extending its head 17. The ejectors 40, composed of attached blocks 42, receive the purified fluid by way of radial channels 43 (FIG. 4) establishing communication between the interior of the bowl and their ejection nozzles 44, the axis of which is directed substantially tangentially in relation to the cylindrical surface 41 of the head 17 of the outer drum B. The tangential jets passing out of the ejectors 40 reach a ring of fixed blades 45 disposed between two radial plates 46 inserted into the cylindrical volute 47 for the exit of the purified liquid. This volute is fixed to the bearing B supporting the centrifuge. The blades 45 are advantageously adjustable in orientation in order to preserve the residual kinetic moment, and disposed in a spiral in order to facilitate the discharge of fluid.

The recuperation of kinetic energy is explained as follows:

The centrifuge being fed axially, the rotation of the liquid produces at every point an elevated pressure $\Delta P = \rho\omega^2 R^2/2$, where $\rho$ is the density of the fluid, $\omega$ the angular velocity of rotation and R the radius of gyration at the point considered.

The pressure is converted into velocity in the nozzle 44 of an ejector in accordance with the equation $$W = \sqrt{\frac{2 \cdot \Delta P}{\rho}}$$

where W is the velocity of the fluid relative to the nozzle. If the orientation and the section of the nozzles are suitably selected, the resulting velocity W is equal in modulus to the peripheral rotational speed. The absolute velocity $\vec{Va}$ of the fluid relative to a frame of reference outside the machine is the geometric sum of the relative velocity $\vec{W}$ and of the drive velocity $\vec{V} = \omega R$ at the point considered: $\vec{Va} = \vec{W} - \vec{V}$. If therefore $\vec{W}$ and $\vec{V}$ are colinear, opposite in direction and of the same modulus, $\vec{Va}$ is zero and the residual kinetic energy is entirely recovered. For practical reasons the outlet angle of the ejector is selected so that the absolute velocity is low but not zero, in order to facilitate discharge (FIG. 5).

The central portion of the inner drum A has a cylindrical axial cavity 48 brought into communication with the space outside the drum by apertures 49. These apertures permit the passage of the lightest fluid flowing along the outer wall 30 and collecting on the periphery of the cavity 48, which constitutes a reservoir from which an extraction tube 50 continuously scoops up the fluid, which is held by the centrifugal action against the wall, in order to discharge it outside the centrifuge.

The solid material discharge device, as previously described, is composed of the scraper screw 36 and of the hydraulic discharge device C, of which a part is formed by the movable plate 19. The overflow 26 is formed by a cylindrical ring 51 fixed on the head 17 and carrying two inwardly projecting rings 52,53 which are axially spaced and of unequal heights, the ring 52 having an inside diameter smaller than that of the ring 53. The ring 52, in conjunction with the outer face 54 of the head 17, bounds a first gutter 55 and, in conjunction with the ring 53, bounds a second gutter 56. A water supply pipe 57, shaped like a crozier, passes into the central openings of the rings 52 and 53 and discharges into the first gutter 55, the bottom of which is in communication via a channel 58 with an annular chamber 59 situated at the periphery of the movable plate 19 between the stepped bearing surfaces 20,21 of the head 17 of the outer drum B. This chamber, which is provided with a calibrated outlet aperture 60 leading into a passage 28, continuously receives by way of the fixed crozier 57, the gutter 55 and the channel 58 a flow of water greater than that flowing through the outlet 60. The excess water overflows from the first gutter, filling the second gutter 56. A radial channel formed in the bottom of the chamber 56 communicates via the duct 25 with the pressure chamber 24 bounded by the movable plate 19 and the inner face 61 of the head 17. Because of the rotation the centrifuged water applies sufficient pressure against the movable plate 19 to hold its periphery bearing axially against the radial bearing surface 62 of the flange 16, in which position it closes the passages 28 bringing the sludge chamber 23 into communication with the outside.

When it is desired to discharge the sludge which has accumulated in the sludge chamber 23, the supply of water through the crozier 57 is interrupted. The outlet apertures 60 effect the emptying of the water chamber 59, and judiciously positioned apertures 63 permit the emptying of the pressure chamber 24. The pressure inside the bowl B acts on the other face of the movable plate 19, so that the latter is moved to the right in the drawing, uncovering the passages 28. The plate 19 is reclosed when the overflow 26 is fed again.

The operation of the centrifuge according to the invention is described below.

The fluid to be treated enters the centrifuge continuously, and fills it completely, by way of the axial hollow shaft 8, in which it starts to acquire a relatively low rotational speed. A first speeding-up stage occurs when the fluid passes into the inclined channels 31 of the inlet wheel, which connect the hollow shaft to the annular space formed between the drums, in which space the stack of dishes 33 fastened to the inner drum A turns at high speed. The liquid to be purified then passes through the set of dishes (arrows in heavy lines), where the centrifugal separation is effected and which constitutes a second speeding-up stage: in known manner the fluid to be purified is accelerated by viscosity in the spaces separating the dishes 33, so that the solid particles are thrown by centrifugal force against the wall of the outer drum B, while the heaviest fluid purified in this manner (arrows in broken lines) flows axially into the space situated at the periphery of the stack of dishes and is brought back to the axis, passing through the centripetal wheel 38, which recuperates part of its rotational energy. The lightest fluid migrates through the action of the centrifugal field (arrows in light lines) towards the inner periphery of each dish and coalesces in the form of a film, which flows towards the axis of the centrifuge. On arriving at the inner edge of the dish, the film is divided into large droplets, which are very quickly collected on the surface 30 of the inner drum A and flow through the apertures 49 into the reservoir 48, where it is recovered through the scoop tube 50.

The heaviest fluid, thus freed of the solid particles and of the ligher fluid, arrives, after passing into the wheel 38, the tubular end of the movable plate 19 and the radial channels 43, at the ejectors 42 attached to the head 17 of the drum B, which ensure a very low absolute exit velocity of the fluid and thus recuperate its residual kinetic energy.

The fixed blades 45 and the volute 47 utilise the residue of kinetic energy of the fluid in order to produce the slight pressure necessary for its discharge.

In one example of embodiment, a centrifuge according to the invention, which is intended for the treatment of waters in the production of petroleum, and in particular for the separation of an oil/water emulsion and solid particles, has the following characteristics:

The rate of flow is 100 cubic meters per hour for an oil concentration at the inlet varying from 100 ppm to more than 2000 ppm, and at the outlet lower than or equal to 20 ppm. The separating power for droplets in suspension of a diameter greater than 2 $\mu$m is complete for a water/oil density difference of 0.15.

The speed of rotation of the assembly comprising the inner drum, the dish clamp and the screw is 5000 rpm, and that of the outer bowl is $\pm$200 rpm relative to the outer drum.

The number of dishes is 560 and the space between the dishes is of the order of 0.5 mm.

The centrifuge has a length of 2.5 meters, with a diameter of the order of 0.70 meter.

The recuperation yield is of the order of 95% relative to the kinetic power transmitted to the fluid.

The solid material discharge device with a movable plate, described above, can have disadvantages when it is used with sludge chambers of moderate volume. In fact, the opening times may not be sufficiently short and a large quantity of liquid is discharged with the solid materials at each opening, which causes an imbalance in the flow of the liquid phases.

Figure 6:
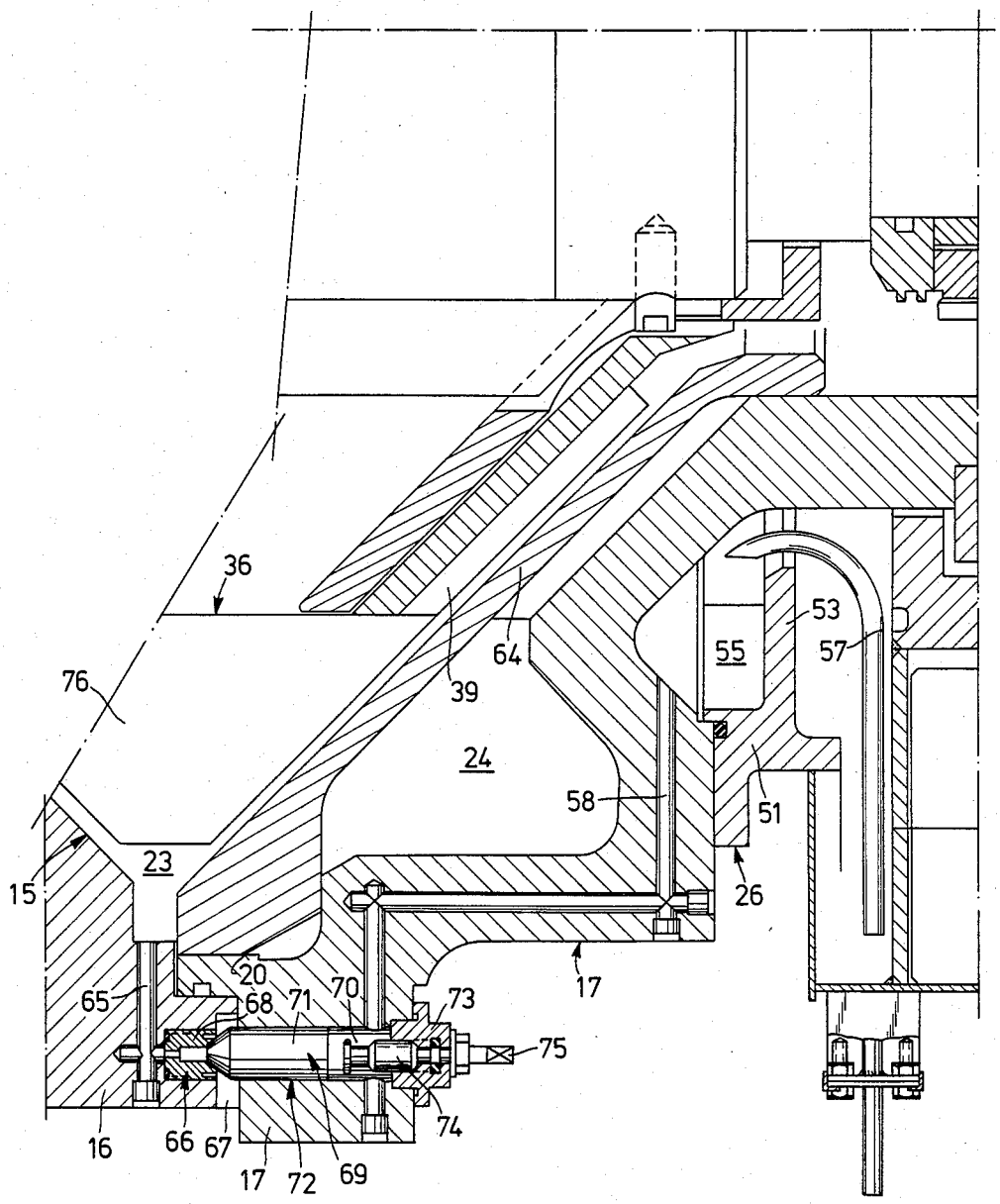
FIG. 6 is a view on a larger scale of part of FIG. 1.

FIG. 6 shows a discharge device with valves, which can advantageously replace the device with a movable plate. It also has the advantage of being simpler to manufacture and of having a lower cost.

The elements of the device which are identical to those of the device described above carry the same reference numbers.

The said discharge device is composed, as previously described, of the scraper screw 36 and the hydraulic discharge device. The sludge chamber 23 is defined between the inner wall of the widened collar 15 and the conical fixed plate 64 forming the inner wall of the head 17. The flange 16 of the bowl, which bears against the periphery of the head 17, carries, distributed regularly around the entire flange, radial apertures 65 which communicate via longitudinal passages 66 with radial grooves 67 formed in the face of the flange 16. The longitudinal passages 66 receive sleeves 68, one of the ends of which forms the seat of valves 69 provided in the periphery of the head 17.

The channels 58, provided in the head 17, lead on one side into the gutter 55, receiving water from the supply pipe 57 shaped like a crozier, and on the other side into the valve chambers 70. The moving parts of the valves 71 slide with play in bores 72 formed parallel to the axis at the periphery of the head. Fluidtight passages 73, mounted over the free openings of the bores, carry a screwthread 74 receiving screw bearings 75. These bearings make it possible to adjust the opening between the moving bodies of the valves and their seats.

The mode of operation of the sludge discharge device with valves is as follows: the water arriving through the supply crozier 57 pours into the gutter 55 of the overflow 26 and is sent under the action of the centrifugal force through the channel 58 into the valve chamber 70. The water exerts a pressure against the rear face of the moving body of the valve and holds it against the seat 68, closing the communication between the sludge chamber 23 and the groove 67 leading to the outside. Part of the water from the chamber 70 flows around the body 71 to the outside, as a result of the play provided between the bore and the moving body. The surplus water (relative to the continuous flow due to the play) arriving in the gutter 55 escapes through the central opening in the ring 53 of the overflow 26.

As in the previous example, when the water supply from the crozier 57 is cut off, the pressure exerted by the sludges and the liquid against the moving body of the valve is no longer balanced by the pressure in the valve chamber 70, and emptying takes place, which is stopped when the water supply from the crozier 57 is re-established.

The above explanation has been given in respect of one valve. The various valves distributed around the head 17 operate simultaneously in the same way.

The continuous exit of water which takes place as a result of the play serves to prevent deposition of solids, which could cause the blockage of the moving body in its bore.

The discharge sections for the solids (5 to 10 $mm^2$) are chosen as a function of the volume of the sludge chamber and the flow speeds in order to obtain easily controllable opening times (10 to $30_s$) without the risk of disturbing the liquid flows.

The construction described above is simple compared with the construction with a movable plate. In fact, the overflow 26 is now provided with only one gutter 55 and is no longer in communication with the chamber 24. The moving parts (valves) are protected against accumulations of solids by a continuous circulation of water.

The sludges accumulate in the chamber 23 and, during discharge, the compactness of the sludge can prevent part of this sludge, situated between two apertures, from being suitably driven away. The sludges then form small mounds which are likely to disturb the balancing of the centrifuge. To overcome this disadvantage, scraper blades 76 have been provided at the end of the scraper screw 36 and of the blades 39, these scraper blades sweeping the chamber 23 in order to prevent asymmetric accumulations of solids during the emptying stages.

We claim:

1. High-output industrial centrifuge with improved energy efficiency, for purifying a liquid containing denser solid particles in suspension and/or droplets of a less dense fluid in emulsion, of the type comprising a rotor essentially comprising a stack of centrifuging dishes rotating at high speed between two coaxial cylindrical drums, means for continuously introducing and discharging the liquid, and means for the selective extraction of the separated impurities, characterized in that in the space between an outer cylindrical drum (B) and an inner drum (A), which drums are independently driven in coaxial rotation and are respectively provided with means for the discharge of the separated phases, is disposed a stack of dishes (33) which rotates with the inner drum and which is fed with liquid to be purified through an axial inlet followed by a centrifugal wheel; in that the purified liquid passes out of the said space through an oulet wheel composed of blade (39) fastened to the inner drum (A) and forming a centripetal turbine, and then through tangential ejectors (40) fastened to the outer drum, (B), and in that a reaction turnstile is formed arranged in such a manner that the absolute exit speed of the purified liquid will be substantially zero, so that the said turbine and the said turnstile restore in the form of driving torque the major part of the kinetic moment imparted to the liquid, and that in consequence the driving power required under continuous operating conditions is limited to compensation for frictional losses.

2. Centrifuge according to claim 1, characterised in that the jets of purified liquid passing out of the ejectors (40) impinge on fixed blades (45) disposed and acting so as to facilitate its discharge.

3. Centrifuge according to claim 2, characterised in that the fixed blades (45) are mounted to be orientable and/or are disposed in a spiral in a volute (47) of revolution.

4. Centrifuge according to claim 1, characterised in that the means of extracting the solid particles comprises a scraper screw (36) which surrounds the stack of dishes (3) fastened to the inner drum (A) and axially delivers the particles which have accumulated on the cylindrical wall of the outer drum (B) turning at a slightly different speed in order to bring them into a peripheral chamber (23) provided at the end of the said outer drum.

5. Centrifuge according to claim 4, characterised in that the peripheral chamber (23) discharges to the outside by way of radial passages (28) normally closed by the periphery of an axially movable plate (19) disposed at the end of the outer drum (B).

6. Centrifuge according to claim 5, characterised in that the movable plate (19) and the outer drum (B) bound an annular chamber (59) which leads to the outside through a calibrated outlet aperture (60) and into which a greater flow of water or other liquid is introduced under a pressure sufficient to hold the said plate in the closed position.

7. Centrifuge according to claim 6, characterised in that the annular chamber (59) communicates through a channel (58) with the bottom, of smaller radius, of an annular gutter (55) provided on the outer wall of the outer drum (B) and open towards its axis, into which gutter the water is poured through a fixed pipe (57) shaped like a crozier.

8. Centrifuge according to claim 7, characterised in that the movable plate (19) and the outer drum (B) bound a second annular chamber (24) inside the first chamber and leading into the interior of the drum through judiciously disposed channels (63), into which second chamber a fraction of the water or other liquid flowing from the gutter (55) into an adjacent gutter (56) is injected under pressure by way of a duct (25).

9. Centrifugal according to claim 4, characterised in that the peripheral chamber (23) leads to the outside via passages normally closed by valve devices (66,69) disposed in the periphery at the end of the outer drum (B).

10. Centrifuge according to claim 9, characterised in that the valve devices (69) communicate via a channel (58) with an annular gutter (55) provided on the outer wall of the drum (B) and open towards its axis, into which gutter the water is poured through a fixed pipe (57) shaped like a crozier.

11. Centrifuge according to claim 10, characterised in that a play is provided between a moving valve body (71) and the bore (72) in which it slides, the said play permitting a continuous exit of water coming from the annular gutter (55).

12. Centrifuge according to claim 4, characterised in that the scraper screw 36 carries, at its end, scraper blades (76) which sweep the peripheral chamber (23).

13. Centrifuge according to claim 1, characterised in that the means for extracting less dense fluid comprise radial passages (49) passing through the wall of the outer drum (A) and a fixed axial extraction tube (50) shaped like a crozier, scooping up the said fluid which has accumulated in the said drum.

14. Centrifuge according to claim 1, characterised in that it is used for purifying effluents or waste waters, particularly in the petroleum industry.

* * * * *